US008860535B2

(12) United States Patent
Augusta et al.

(10) Patent No.: US 8,860,535 B2
(45) Date of Patent: Oct. 14, 2014

(54) TEST BUTTON FOR AN ELECTRICAL SWITCHING DEVICE AND ELECTRICAL SWITCHING DEVICE

(71) Applicants: Zbynek Augusta, Letohrad (CZ); Lukas Kalous, Vermerovice (CZ); Pavel Naiman, Letohrad (CZ); Milos Petracek, Letohrad (CZ); Pavel Safar, Pisecná (CZ)

(72) Inventors: Zbynek Augusta, Letohrad (CZ); Lukas Kalous, Vermerovice (CZ); Pavel Naiman, Letohrad (CZ); Milos Petracek, Letohrad (CZ); Pavel Safar, Pisecná (CZ)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 13/755,451

(22) Filed: Jan. 31, 2013

(65) Prior Publication Data

US 2013/0199902 A1 Aug. 8, 2013

(30) Foreign Application Priority Data

Feb. 8, 2012 (DE) ..... 10 2012 201 852

(51) Int. Cl.
*H01H 73/00* (2006.01)
*H01H 9/22* (2006.01)
*H01H 83/04* (2006.01)

(52) U.S. Cl.
CPC *H01H 9/22* (2013.01); *H01H 83/04* (2013.01)
USPC ..... 335/18

(58) Field of Classification Search
USPC ..... 335/18
See application file for complete search history.

(56) References Cited

U.S. PATENT DOCUMENTS

| | | | | | |
|---|---|---|---|---|---|
| 3,649,784 | A | * | 3/1972 | Middendorf et al. | 200/43.14 |
| 4,733,029 | A | * | 3/1988 | Kobayashi et al. | 200/43.15 |
| 4,982,173 | A | * | 1/1991 | Meiners et al. | 335/21 |
| 4,983,939 | A | * | 1/1991 | Shea et al. | 335/42 |
| 5,060,107 | A | * | 10/1991 | Castonguay | 361/115 |
| 5,113,043 | A | * | 5/1992 | Morris | 200/43.01 |
| 5,120,921 | A | * | 6/1992 | DiMarco et al. | 200/401 |

(Continued)

FOREIGN PATENT DOCUMENTS

| | | | | |
|---|---|---|---|---|
| DE | 1170503 | B | | 5/1964 |
| DE | 19846996 | A1 | | 5/2000 |
| GB | 2342780 | B | | 11/2002 |
| JP | 2001060429 | A | * | 3/2001 |

OTHER PUBLICATIONS

Berufgenossenschaft Der Feinmechanik und Elektrotechnik; Auswahl und Anbringung elektromechanischer Verriegelungseinrichtungen für Sicherheitsfunktionen; pp. 1-43; Beuth-Verlag GmbH Berlin; 2003; DE.

*Primary Examiner* — Shawki S Ismail
*Assistant Examiner* — Lisa Homza
(74) *Attorney, Agent, or Firm* — Harness, Dickey & Pierce, P.L.C.

(57) ABSTRACT

A test button is disclosed for an electrical switching device, especially for a circuit breaker; and an electrical switching device is disclosed, especially a circuit breaker, with a test button. The test button is at least one embodiment is embodied for actuation of a tripping mechanism of the electrical switching device. In this case, the test button actuates the tripping mechanism on the one hand if the test button is actuated manually and on the other hand if a cover element of the electrical switching device is opened. The actuation of the tripping mechanism by way of the test button ensures that the electrical switching device cannot be switched on or tripped respectively.

13 Claims, 9 Drawing Sheets

(56) References Cited

U.S. PATENT DOCUMENTS 5,293,142 A * 3/1994 Fello et al. ..... 335/18
5,293,522 A * 3/1994 Fello et al. ..... 335/18
5,872,495 A * 2/1999 DiMarco et al. ..... 335/35
6,140,897 A * 10/2000 Mueller et al. ..... 335/172
6,373,004 B1 * 4/2002 Jackson ..... 200/50.1
6,747,534 B1 * 6/2004 Mueller et al. ..... 335/38
7,218,192 B2 * 5/2007 Stay et al. ..... 335/6
7,535,327 B2 * 5/2009 Desilva et al. ..... 335/174
7,538,646 B2 * 5/2009 Mikl ..... 335/78
7,558,034 B2 * 7/2009 Bonasia et al. ..... 361/42
2013/0199902 A1 * 8/2013 Augusta et al. ..... 200/50.02

* cited by examiner

TEST BUTTON FOR AN ELECTRICAL SWITCHING DEVICE AND ELECTRICAL SWITCHING DEVICE

PRIORITY STATEMENT

The present application hereby claims priority under 35 U.S.C. §119 to German patent application number DE 10 2012 201 852.2 filed Feb. 8, 2012, the entire contents of which are hereby incorporated herein by reference.

FIELD

At least one embodiment of the invention generally relates to a test button for an electrical switching device, especially for a circuit breaker.

At least one embodiment of the invention further generally relates to an electrical switching device such as a circuit breaker, especially a compact circuit breaker.

BACKGROUND

Electrical switching devices, such as circuit breakers, have the task of uncoupling a number of consumers from a power supply network when a specific fault occurs. The classical fault is the occurrence of a short-circuit current and the circuit breakers are conventionally configured to move a switching element in the event of such a short circuit current and thus to decouple the connection between consumers and network.

Electrical switching devices include circuit breakers in the low voltage range. "Low voltage" typically means voltages up to 1000 volts. With an appropriate mechanical design of the switching disconnection lines, these types of switching devices can also be designed for switching voltages of over 1000 volts, such as up to 6.3 kV for example. In particular these types of electrical switching devices such as low voltage circuit breakers are embodied to interrupt current paths in the event of an overcurrent or in the event of a short circuit. They can be designed as single-pole or multi-pole units, especially three-pole units.

These types of electrical switching device are generally known. They have at least one moving contact, at the free end of which a contact piece is disposed. When the switching device is closed this contact piece rests against an opposing contact piece of at least a fixed contact.

The switching device can be switched on and also off manually by way of a handle. The handle is generally embodied as a pivoting handle which is able to be pivoted from an off position to an on position and vice versa. In such cases the handle indicates through its respective position whether the switch is switched on or switched off.

Disposed within the electrical switching device is a switching mechanism by which the movable contact can be moved. Such a switching device also has a tripping mechanism, especially in the form of a tripping shaft, which is able to be bought into active contact with the switching mechanism for tripping the switching device.

The functionality of the electrical switching device can be tested via a test button. The test button in this case is effectively connected to the tripping mechanism. During an actuation of the test button the tripping mechanism can be moved such that it actuates the switching mechanism for separating the at least one movable contact from the at least one fixed contact, in other words for tripping the switching device.

It is not permissible for electrical switching devices, such as circuit breakers, to be able to be switched on when the cover element, which can especially be an accessory cover, is open. This means that if the handle of an electrical switching device is switched on with an opened cover element or accessory cover, either the handle must be blocked before it reaches the switch-on position or the switching device must trip before the switch-on position is reached.

SUMMARY

At least one embodiment of the present invention ensures that an electrical switching device, especially a circuit breaker, such as a compact circuit breaker, is not switched on when a cover element, especially an accessory cover, is open.

A test button for an electrical switching device and an electrical switching device are disclosed. Further features and details of the invention emerge from the subclaims, the description and the enclosed drawings. In this connection features which are described in conjunction with embodiments of the inventive test button naturally also apply in conjunction with embodiments of the inventive electrical switching device and vice versa, so that there is or can always be mutual reference to the individual aspects in relation to the disclosure.

In accordance with the first aspect of at least one embodiment of the invention, a test button is disclosed for an electrical switching device with a cover element and a tripping mechanism, especially for a circuit breaker, such as a compact circuit breaker, wherein the test button has a stop contour with a first contact surface and a second contact surface. In this case the first contact surface is embodied for actuating the tripping mechanism of the electrical switching device during a manual actuation of the test button and the second contact surface is embodied for actuating the tripping mechanism of the electrical switching device during an opening of the cover element of the electrical switching device.

BRIEF DESCRIPTION OF THE DRAWINGS

Example embodiments of the inventive test button for an electrical switching device as well as its advantages are explained below in greater detail with reference to the drawings, which are schematic diagrams in each case in which.

Elements with the same function and method of operation are provided with the same reference characters each case in FIGS. 1 to 8.

DETAILED DESCRIPTION OF THE EXAMPLE EMBODIMENTS

Figure 1:
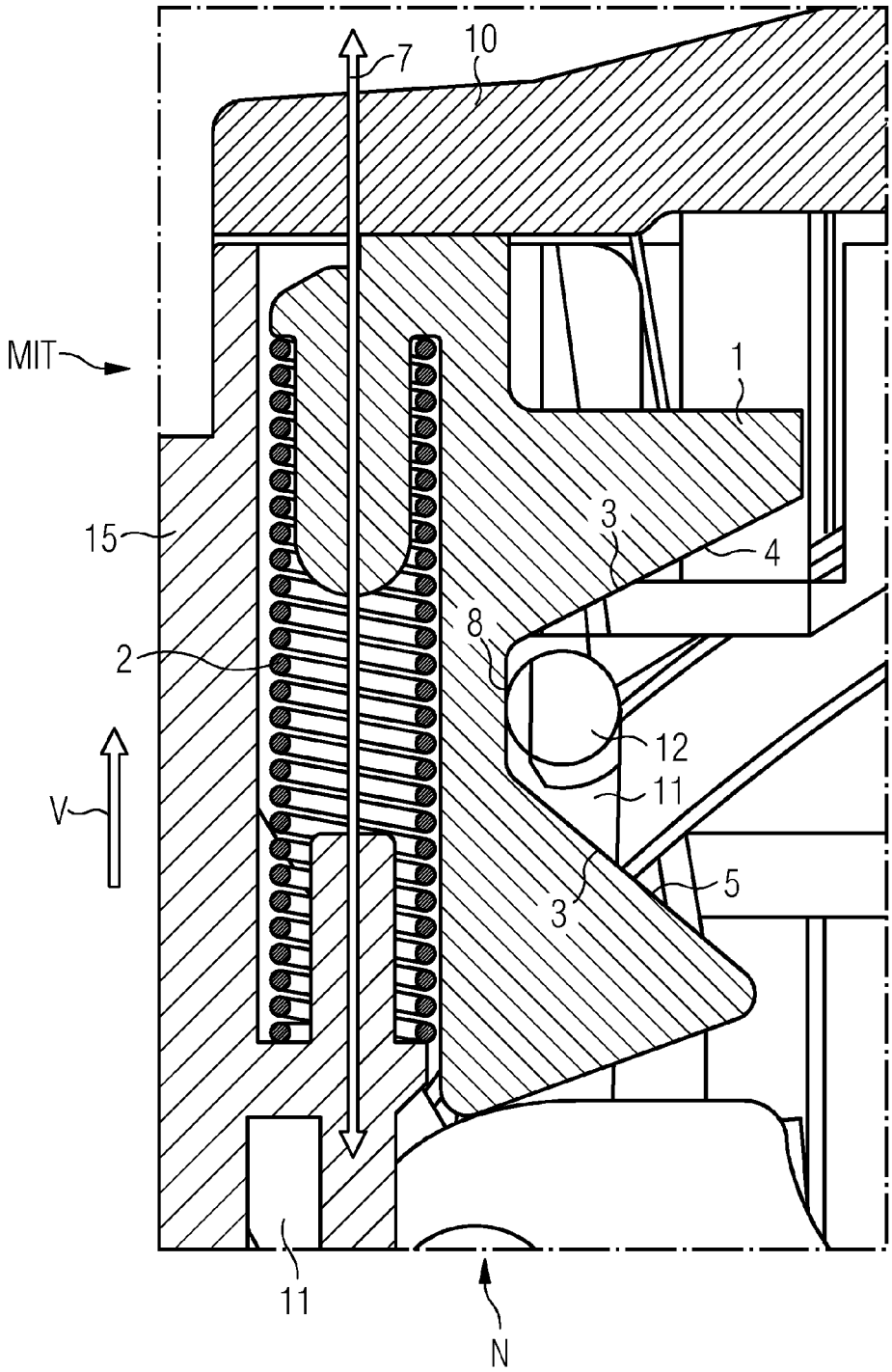
FIG. 1 shows a sectional diagram of a test button which is in a non-actuated position within the electrical switching device.
Figure 1A:
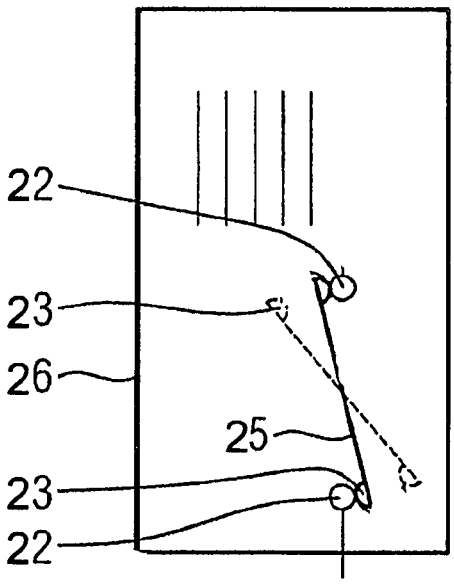

The present invention will be further described in detail in conjunction with the accompanying drawings and embodiments. It should be understood that the particular embodiments described herein are only used to illustrate the present invention but not to limit the present invention.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

In accordance with the first aspect of at least one embodiment of the invention, a test button is disclosed for an electrical switching device with a cover element and a tripping mechanism, especially for a circuit breaker, such as a compact circuit breaker, wherein the test button has a stop contour with a first contact surface and a second contact surface. In this case the first contact surface is embodied for actuating the tripping mechanism of the electrical switching device during a manual actuation of the test button and the second contact surface is embodied for actuating the tripping mechanism of the electrical switching device during an opening of the cover element of the electrical switching device.

A test button embodied in this way for an electrical switching device ensures that the electrical switching device, especially a circuit breaker, such as a compact circuit breaker, is not switched on when the cover element is open. At the same time, a test button of this type makes it possible to check the functioning of the electrical switching device by manually actuating the test button.

The test button has a stop contour with a first contact surface and a second contact surface. The tripping mechanism of an electrical switching device can be moved by at least one embodiment of the inventive test button in two different ways. On the one hand the tripping mechanism of an electrical switching device can be actuated when the test button is actuated manually to check the functioning of the electrical switching device. In this case the test button is disposed on the electrical switching device, especially on and/or in a housing element of the electrical switching device, such that this can be actuated by an operator. On the other hand the test button or the stop contour of the test button is embodied such that the tripping mechanism of an electrical switching device is also then actuated when the cover element of the electrical switching device, which covers the test button in the closed state, is opened.

In accordance with an example development of the invention there can be provision with a test button for the test button to be embodied for movable support in a direction of movement in and/or on the electrical switching device and for the first contact surface and the second contact surface to run inclined opposingly to the direction of movement of the test button, wherein the first contact surface and the second contact surface run at an angle of between 30° and 150°, especially between 60° and 120°, to one another. Advantageously the two contact surfaces are disposed in a V shape in relation to one another. This embodiment of the test button makes it possible for a tripping mechanism of an electrical switching device, especially a guide element of a tripping mechanism, to be disposed between the stop contour, i.e. the first contact surface and the second contact surface, of the test button such that, with a movement of the test button both in one direction and also in the other direction in the direction of movement, the tripping element of the electrical switching device, by striking the stop contour of the test button, is carried along by the latter, in which case the mechanism is transferred from a neutral position into a tripping position. That means that a test button embodied in such a way, as a result of the V-shaped arrangement of the first and the second contact surface of the stop contour in relation to one another, ensures a movement of a tripping mechanism disposed between the contact surfaces for a movement of the test button in both directions in the direction of movement of the test button.

This double functionality of the test button enables an electrical switching device, such as a circuit breaker for example, to be embodied simply and at low cost, in order to both provide a test functionality of the electrical switching device, and also to ensure that the electrical switching device is not switched on when the cover element of the electrical switching device is opened. In this case the test button is embodied such that this button, when the cover element which covers the test button is opened, trips the tripping mechanism of an electrical switching device such that this ensures, in interaction with a pawl of the electrical switching device, that either the electrical switching device cannot be switched from an OFF position into an ON position or that a switched-on electrical switching device is switched off or tripped respectively.

Preferably there can be provision with a test button for the first contact surface and/or the second contact surface to be embodied flat or curved. The shape of the contact surfaces as well as the inclination of the contact surfaces relative to the direction of movement of the test button ensure that, when the tripping mechanism makes contact, the tripping mechanism of an electrical switching device is rotated or pivoted. In such cases the speed of the rotation or pivoting of the tripping mechanism of the electrical switching device is especially dependent on the shape and the incline of the contact surfaces relative to the direction of movement of the test button.

In particular the first and the second contact surface are disposed such that, for a movement of the test button in its direction of movement relative to the electrical switching device, these take the tripping mechanism with them simply and rapidly by sliding along at least one area of the tripping mechanism on the first or the second contact surface of the test button respectively and, in doing so, rotate or pivot these surfaces respectively. Especially preferably the first and the second contact surface are disposed in relation to each other at an angle of between 60° and 120°, so that it is guaranteed that the at least one area of the tripping mechanism slides securely along the contact surfaces.

There can also be provision with a test button that, for tensioning the test button with the electrical switching device, the test button has a spring element. The spring element ensures that the test button can be guided from an actuated position back into a non-actuated position after the test button has been manually moved into an actuated position for checking the functionality of the electrical switching device. The spring element can further ensure that when the cover element is opened, the test button is moved from a central position into an OFF position, in order in this way to prevent the electrical switching device being switched on. The spring element can be embodied in different ways. For example the spring element can be embodied as an elastomer spring. Especially preferably the spring element is embodied as a compression spring, especially as a screw compression spring.

Such an embodiment of the spring element guarantees a secure return of a manually actuated test button from the actuated position into a non-actuated position or from a non-actuated position into an OFF position if the cover element of the electrical switching device is opened.

In accordance with a further preferred development of at least one embodiment of the invention there can be provision with a test button for the stop contour to have a central area between the first contact surface and the second contact surface, which is disposed in parallel or essentially in parallel to the direction of movement. In this case the central area of the stop contour, together with the first and the second contact surface and also at least the area of the tripping mechanism which is disposed between the contact surfaces and the stop contour, can be matched to each other so that when the test button is moved out of the central position, the tripping mechanism is gripped directly or approximately directly by the stop contour of the test button in order to actuate the tripping mechanism.

In accordance with a second aspect of at least one embodiment of the invention the object is achieved by an electrical switching device, especially a circuit breaker such as a compact circuit breaker, having a switching mechanism for connecting and disconnecting at least one movable contact from at least one fixed contact of the electrical switching device, a housing element for accommodating internal accessory components, an element for covering the internal accessory components, a test button and a tripping mechanism for the switching mechanism, wherein the tripping mechanism is able to be moved between a neutral position and a tripping position and wherein the test button, for actuating the tripping mechanism, is able to be bought into active contact with the latter. The electrical switching device preferably has a moving contact and a fixed contact. On the other hand the electrical switching device can also have two or more moving contacts and accordingly two or more fixed contacts.

The housing element of the electrical switching device is embodied for accommodating the switching mechanism of the electrical switching device. The switching mechanism can be embodied in different ways. Typically the switching mechanism has a tensioning lever able to be activated by a switching lever, whereby the tensioning lever can be actuated by a tensioning roller which is disposed on the switching lever. The switching mechanism further preferably has an knuckle joint which is in active contact with the tensioning lever of the switching mechanism such that, when the tensioning lever is moved, the knuckle joint moves the at least one moving contact of the electrical switching device in order to make a connection between said contact and the at least one fixed contact order to disconnect it from the latter.

The tensioning lever is able to be pre-tensioned by a spring element. Furthermore the switching mechanism can have at least one rocker lever which is disposed rotatably or pivotably respectively on the tensioning lever of the switching mechanism and which is able to be bought into active contact with a pawl of the switching mechanism.

The cover element is embodied for covering internal accessory components. Especially preferably the cover element is embodied as an accessory cover element to accommodate different types of accessory elements for the electrical switching device. The tripping mechanism of the electrical switching device, depending on its position, is able to be bought into active contact with the switching mechanism. In particular the tripping mechanism, which is preferably embodied as a tripping shaft, can be bought into active contact with the pawl of the switching mechanism, in order to pivot or to rotate the latter. This means the tripping mechanism is able to be moved between a neutral position and a tripping position.

In the neutral position the tripping mechanism makes it possible for the electrical switching device to be reset from a TRIP position into a RESET position or for the electrical switching device to be switched on from an OFF position into an ON position. In the tripping position of the tripping mechanism the tripping mechanism engages on the pawl of the switching mechanism in order to pivot the latter such that the electrical switching device is tripped, i.e. is transferred from an ON position into the TRIP position. In this case the pawl releases the tensioning lever or the at least one rocker lever of the switching mechanism so that the tensioning lever, as a result of the spring forces acting on it, is pivoted in order in this way to separate the at least one moving contact from the at least one fixed contact. Furthermore it is ensured in the tripping position that the switching mechanism or the electrical switching device respectively cannot be switched on.

At least one embodiment of the inventive electrical switching device is further characterized in that the test button is embodied in accordance with the first aspect of the invention, wherein the test button is able to be moved between an actuated position and a non-actuated position and an OFF position, that the switching mechanism, when the test button is moved from the non-actuated position against the tensioning force of a spring element into the actuated position, separates the at least one moving contact from the least one fixed contact of the electrical switching device, wherein, when the test button is moved from the non-actuated position into the actuated position, at least one area of the tripping mechanism for moving the tripping mechanism from the neutral position into the tripping position is able to be guided along the first contact surface, that the switching mechanism, when the test button is moved by the pre-tensioning force of the spring element from the non-actuated position into the actuated position, separates the at least one moving contact from the at least one fixed contact of the electrical switching device, wherein, when the test button is moved from the non-actuated position into the OFF position the at least one area of the tripping mechanism for moving the tripping mechanism from the neutral position into the tripping position is able to be guided along the second contact surface, and that in the central position of the test button the tripping mechanism is disposed relative to the switching mechanism so that the electrical switching device is able to be reset from a TRIP position into a RESET position and from an OFF position into an ON position.

An electrical switching device, such as a circuit breaker in particular, embodied in this way ensures that the electrical switching device, when a cover element is open, in particular in the event of an opened accessory cover which covers the test button when the cover element is closed, is not switched on. Either this type of electrical switching device is tripped when the cover element is opened, i.e. transferred from the ON position into the TRIP position, or an electrical switching device which is in the OFF position is prevented from being able to be switched on. Advantageously, with this type of electrical switching device, no additional component, such as a rocker for example, which is able to be brought into active connection with the test button when the cover element of the electrical switching device is opened, is required. This type of electrical switching device is able to be manufactured easily and at low cost.

The spring element can be a part of the test button or can be embodied as a separate element. The test button assumes the central position when the cover element which covers the test button is closed, meaning that it is resting against the housing element of the electrical switching device. The cover element of the electrical switching device has an opening for actuation of the test button when the cover element is closed. This means that the test button can be moved manually by an operator from the non-actuated position into the actuated position by the operator pressing the test button through the opening of the cover element in the direction of the interior of the electrical switching device.

In accordance with a preferred development of at least one embodiment of the invention there can be provision with an electrical switching device for the test button to be able to be moved, on closure of the cover element, from the OFF position into the non-actuated position against the pre-tensioning force of the spring element and for the test button, when the cover element is opened, to be able to be moved by the pre-tensioning force of the spring element from the non-actuated position into the OFF position. This ensures that the spring element is pre-tensioned in the direction of the spring element when the cover element is closed. The spring element, preferably embodied as a compression spring, is compressed by the cover element as the cover element is closed. When the cover element is opened the pretensioned spring element moves the test button from the non-actuated position into the OFF position, in which the test button advantageously projects from the electrical switching device or over the edge of the housing element of the electrical switching device respectively. The spring element can for example also be embodied as an elastomer spring or similar.

The test button is disposed movably on the electrical switching device so that it is able to be moved backwards and forwards from a non-actuated position, known as the test position, an OFF position and an actuated position.

Especially preferred is an electrical switching device in which the test button is movably supported to allow linear displacement on the electrical switching device, especially on a housing element of the electrical switching device. In this case the test button is disposed movably to allow linear displacement on the electrical switching device or on the housing element of the electrical switching device respectively such that, when the test button is displaced into the actuated position, the first stop surface of the stop contour rotates or pivots the tripping mechanism of the electrical switching device. At the same time the test button is disposed on the electrical switching device such that, when the test button is moved from the actuated position back into the non-actuated position, the tripping mechanism is moved from the tripping position back into the neutral position. If the cover element of the electrical switching device is opened, the pre-tensioning force of the spring element ensures that the test button is displaced in a linear manner from the non-actuated position into the OFF position, so that the tripping mechanism, by engaging with the second contact surface of the stop contour of the test button, is once again moved from the neutral position into the tripping position.

There can further be provision in an electrical switching device, in the non-actuated position of the test button, for the at least one area of the tripping mechanism to be disposed on or next to a central area of the stop contour. This means that the tripping mechanism or at least an area of the tripping mechanism can, in the non-actuated position of the test button or in the neutral position of the tripping mechanism, be touching the stop contour or the central area of the stop contour. However it is also conceivable that, in the neutral position of the tripping mechanism, the tripping mechanism or the at least one area of the tripping mechanism is adjacent to the central area of the stop contour of the test button without actually touching it.

As soon as the test button is displaced from the non-actuated position, one of the contact surfaces comes into contact with the at least one area of the tripping mechanism in order to move said mechanism from the neutral position into the tripping position. The at least one area of the tripping mechanism which is embodied for contacting the stop contour of the test button, is preferably embodied as a guide element. In this case the at least one area of the tripping mechanism embodied as a guide element can be formed by a projection, especially a stud. The tripping mechanism, which is preferably embodied as a tripping shaft, can be supported rotatably around an axis of rotation within the electrical switching device. The guide element is preferably disposed on the tripping mechanism with its axis parallel to the axis of rotation of said tripping mechanism. It is also conceivable for the guide element to be supported rotatably on the tripping mechanism.

At least one embodiment of the inventive electrical switching device which has a test button in accordance with the first aspect of at least one embodiment of the invention accordingly provides the same advantages as have been explained in detail in relation to the test button in accordance with the first aspect of at least one embodiment of the invention. Especially preferably the electrical switching device is a circuit breaker, especially a compact circuit breaker. A circuit breaker in this case can be an electromagnetic automatic circuit breaker. It is often also used as a power circuit breaker, i.e. as an overcurrent protection device in an electrical installation. A compact circuit breaker in particular can often be used for low voltages. The use of the electrical switching device as a motor protection switch is also conceivable. An embodiment of the inventive electrical switching device as a circuit breaker, especially as a compact circuit breaker, thus makes it possible to use the electrical switching device for a plurality of applications.

FIGS. 1 to 6 each show the same test button 1, which is disposed to enable it to be displaced in a linear manner within an electrical switching device or on a housing element 15 of the electrical switching device. The test button 1 has a stop contour 3, wherein the stop contour 3 has a first contact surface 4, a central area 8 and a second contact surface 5. The first contact surface 4 of the stop contour 3 is embodied for actuation of the tripping mechanism 11 of the electrical switching device if the test button 1 is actuated manually. The second contact surface 5 of the stop contour 3 is embodied to actuate the tripping mechanism 11 of the electrical switching device when the cover element 10 of the electrical switching device is opened. The first contact surface 4 and the second contact surface 5 are disposed opposite one another are inclined to the direction of movement 7 of the test button 1. The direction of movement 7 means the direction in which the test button 1 is able to be moved with a linear displacement between an OFF position AUS, a non-actuated position MIT and an actuated position EIN.

The inclination of the first contact surface 4 and the second contact surface 5 to the direction of movement 7 is preferably embodied such that these surfaces can slightly rotate or pivot the tripping mechanism 11 during a movement of the test button 1. The first contact surface 4 and the second contact surface 5 are preferably disposed in the shape of a V in relation to one another. In particular the first contact surface 4 and the second contact surface 5 enclose an angle of between 60 and 90°.

The first contact surface 4 and the second contact surface 5 of the stop contour 3 are embodied flat in the example embodiments of the test button 1 shown. It is also conceivable for the contact surfaces 4, 5 to be embodied raised or curved respectively.

The test button 1 is pre-tensioned with a spring element 2 which is especially embodied as a compression spring in the position shown in FIG. 1 in the direction of the cover element 10 with a pre-tensioning force V. This means that with a closed cover element 10 the test button 1 is in a non-actuated position MIT, in which the spring element 2 pre-tensions the test button 1 in the direction of movement 7 with a pre-tensioning force V against the cover element 10.

The tripping mechanism 11 of the electrical switching device, in the non-actuated position MIT of the test button 1, is in a neutral position N. In this neutral position N of the tripping mechanism 11 the tripping mechanism 11 is disposed in relation to a switching mechanism of the electrical switching device not shown in any greater detail so that the tripping mechanism 11 can be reset from a TRIP position into a RESET position and can be switched from an OFF position into an ON position. In the non-actuated position MIT of the test button 1 or in the neutral position N of the tripping mechanism 11, the tripping mechanism 11 can be in touch contact with the stop contour 3 of the test button 1. However it is also conceivable for a degree of play to be present between the tripping mechanism 11 and the stop contour 3, especially the central area 8 of the stop contour 3.

The tripping mechanism 11 of the electrical switching device, which is especially embodied as a circuit breaker, especially preferably as a compact circuit breaker, has a guide element 12 which is disposed especially as a projection on the tripping mechanism 11. This guide element 12 forms the area of the tripping mechanism 11 which, when the test button 1 is displaced in the direction of movement 7 comes into active contact with the stop contour 3 of the test button 1. This means that when the test button 1 is moved from the non-actuated position MIT into an actuated position EIN or into an OFF position AUS, the guide element 12 moves into the engagement with the first contact surface 4 or the second contact surface 5 of the stop contour 3.

Figure 2:
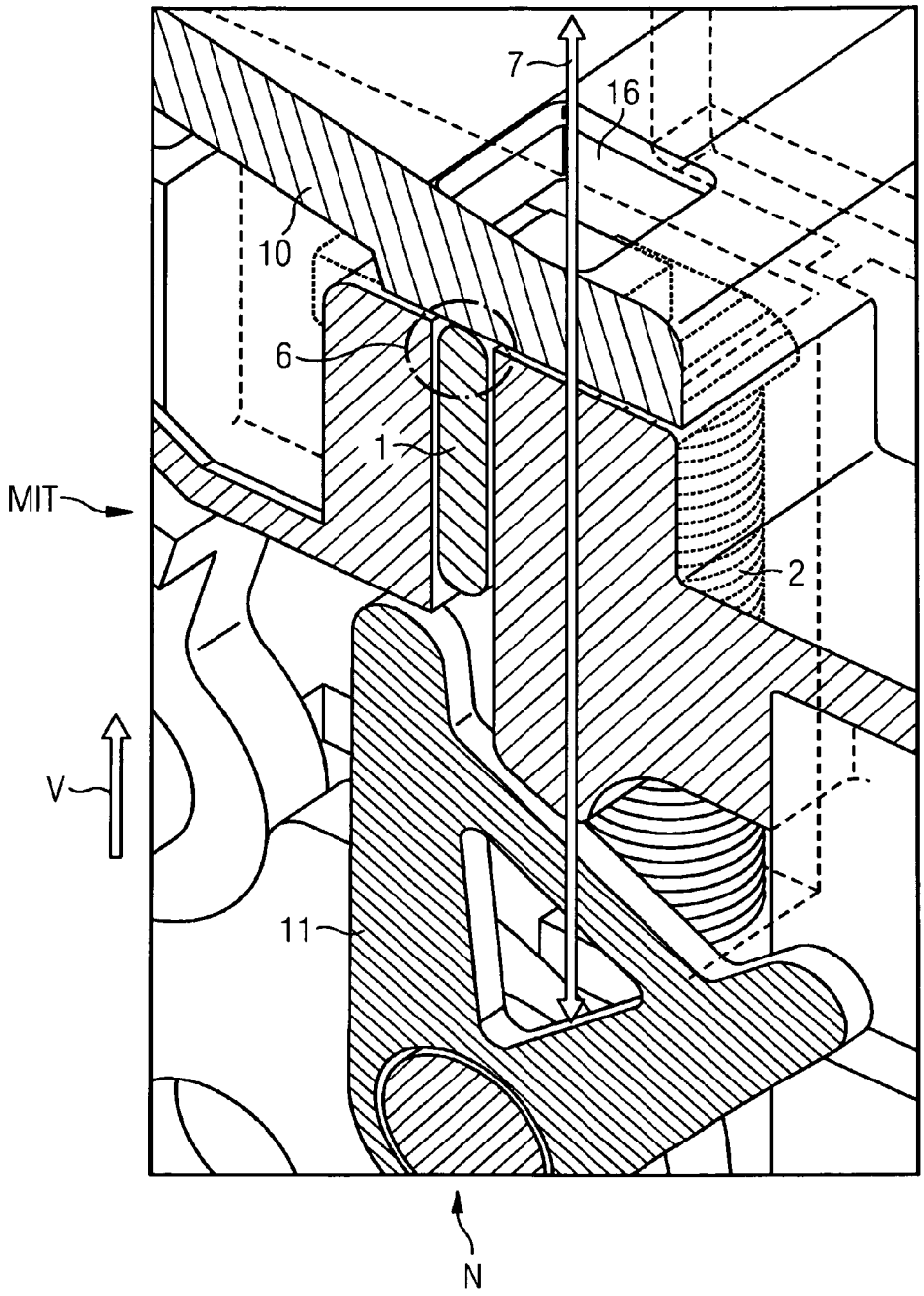
FIG. 2 shows a perspective view of the test button disposed within an electrical switching device in accordance with FIG. 1.

FIG. 2 shows a schematic diagram of the position of the test button 1 within the electrical switching device with the cover element 10 closed. During the closing process of the cover element 10 of the electrical switching device the test button 1 has been moved by the cover element 10 into the non-actuated position MIT. In this non-actuated position MIT the test button 1 rests with its contact surface 6 against the inner side of the cover element 10. The cover element 10 in this case has moved the test button 1 against the pre-tensioning force V into the non-actuated position MIT.

Figure 3:
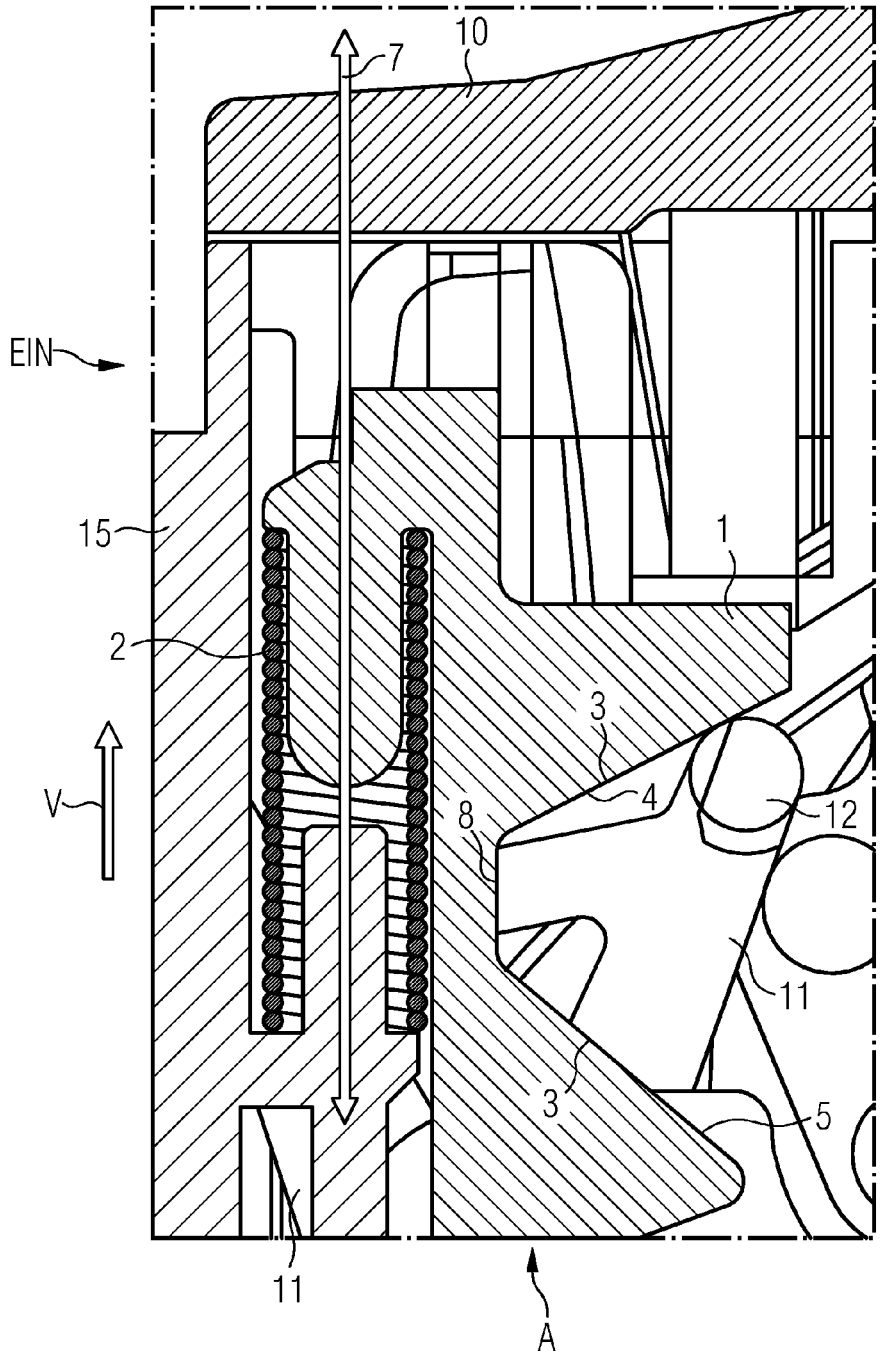
FIG. 3 shows a sectional diagram of the test button in accordance with FIG. 1, which is in a non-actuated position.

FIG. 3 shows a schematic sectional view of the test button 1 in the actuated position EIN. This means that FIG. 3 shows the test button 1, which has been moved manually by an operator from the non-actuated position MIT into the actuated position EIN. By the linear displacement of the test button 1 in the direction of movement 7 into the interior of the electrical switching device, especially along the housing element 15 of the electrical switching device, the guide element 12 of the tripping mechanism 11 has been guided on the first contact surface 4 of the stop contour 3 of the test button 1 and has been rotated by this process. This means that when the test button 1 is moved from the non-actuated position MIT against the pre-tensioning force V of the spring element 2 into the actuated position EIN, the switching mechanism of the electrical switching device not shown in the diagram separates the at least one movable contact from the at least one fixed contact of the electrical switching device. This means that by rotation or pivoting respectively of the tripping mechanism 11, the tripping mechanism 11 comes into active contact with the switching mechanism of the electrical switching device so that the switching mechanism is tripped.

In the actuated position EIN of the test button 1 the tripping mechanism 11 is located in the tripping position A. During the movement of the test button 1 from the non-actuated position MIT into the actuated position EIN the guide element 12 of the tripping mechanism 11, in order to move the tripping mechanism 11 from the neutral position N into the tripping position A, has been guided along the first contact surface 4. With this movement of the tripping mechanism 11 from the neutral position N into the tripping position A the tripping mechanism 11 moves into operational active contact with the switching mechanism, especially a pawl of the switching mechanism, wherein in the tripping position A the tripping mechanism 11 releases the pawl of the switching mechanism so that the switching mechanism can move such that the at least one moving contact is separated from the at least one fixed contact of the electrical switching device.

Figure 4:
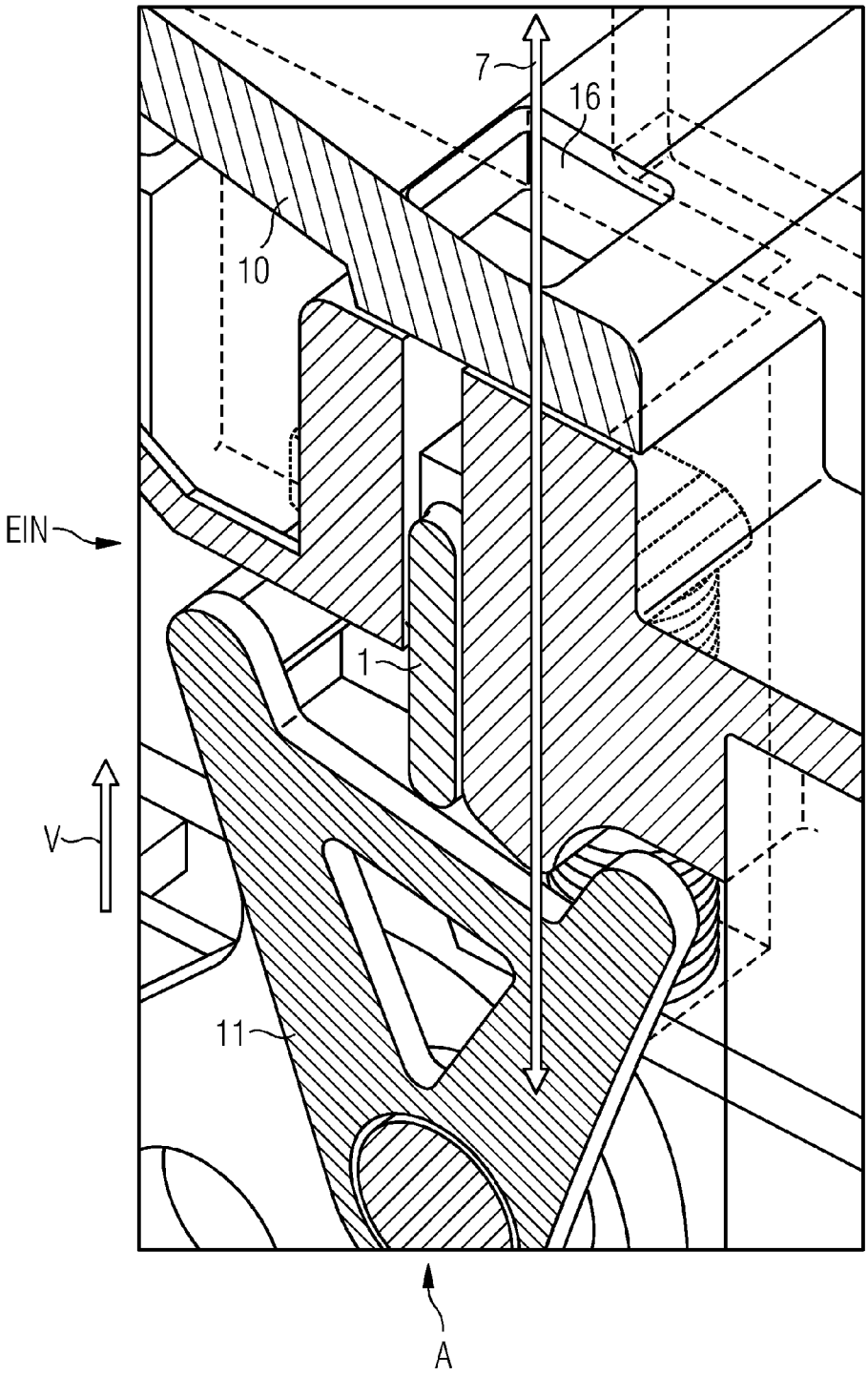
FIG. 4 shows a perspective view of the test button in accordance with FIG. 3 in the actuated position within the electrical switching device.

FIG. 4 shows a schematic perspective view of the test button 1 in the actuated position EIN as well as the tripping mechanism 11 in the tripping position A.

Figure 5:
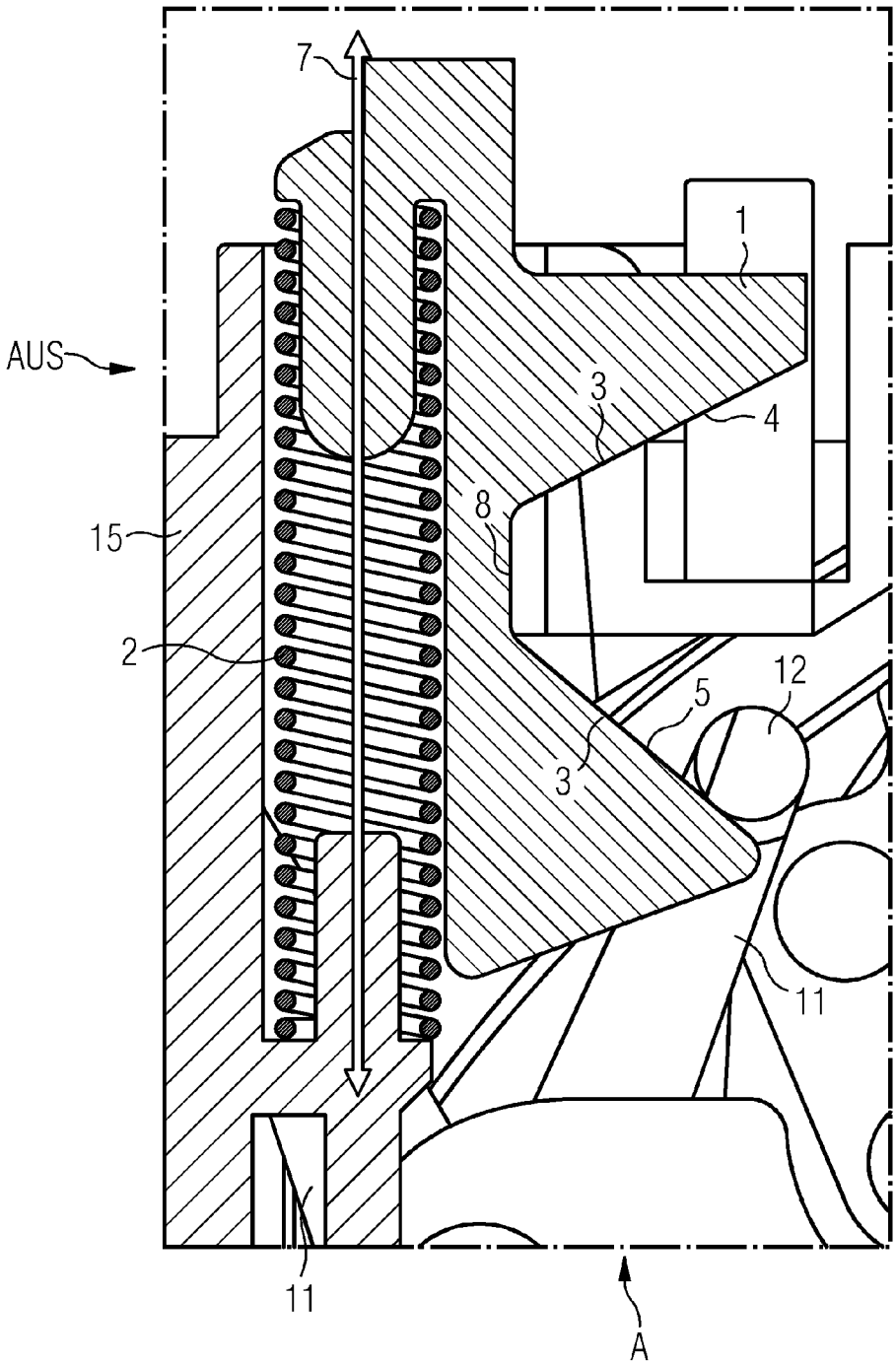
FIG. 5 shows a sectional diagram of the test button in an OFF position, with the cover element opened.

FIG. 5 shows a schematic sectional view of the test button 1, when this is in the OFF position AUS. This OFF position AUS has been reached by opening the cover element 10, which is not shown in this FIG. 5. When the cover element 10 is opened the spring element 2 pushes the test button 1 in the movement direction 7 towards the cover element 10. When the test button 1 is moved by the pre-tensioning force V of the spring element 2 from the non-actuated position MIT into the OFF position AUS, the switching mechanism separates the at least one moving contact from the at least one fixed contact of the electrical switching device.

When the test button 1 is moved from the non-actuated position MIT into the OFF position AUS the guide element 12 of the tripping mechanism 11 has been guided along the second contact surface 5 to move the tripping mechanism 11 from the neutral position N into the tripping position A. This means that the tripping position A of the tripping mechanism 11, in the OFF position AUS of the test button 1, corresponds to the tripping position A of the tripping mechanism 11 in the actuated position EIN of the test button 1. Compared to the situation shown in FIG. 3 the tripping mechanism 11 has not been moved by the first contact surface 4 of the stop contour 3, but by the second contact surface 5 of the stop contour 3.

Figure 6:
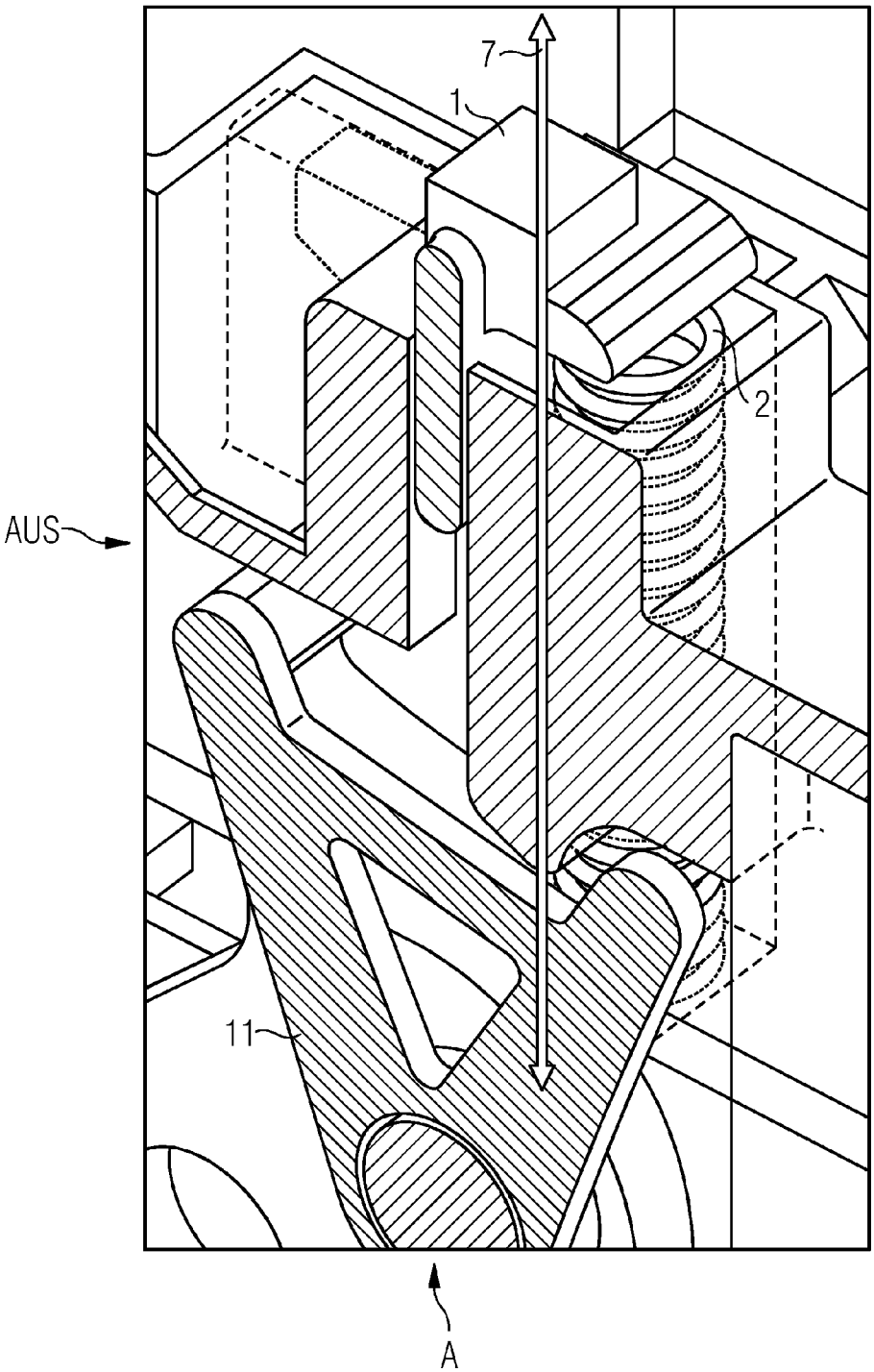
FIG. 6 shows a perspective view of the test button in accordance with FIG. 5 in the OFF position.

FIG. 6 shows a schematic perspective view of the test button 1 within the electrical switching device in the OFF position AUS.

Figure 7:
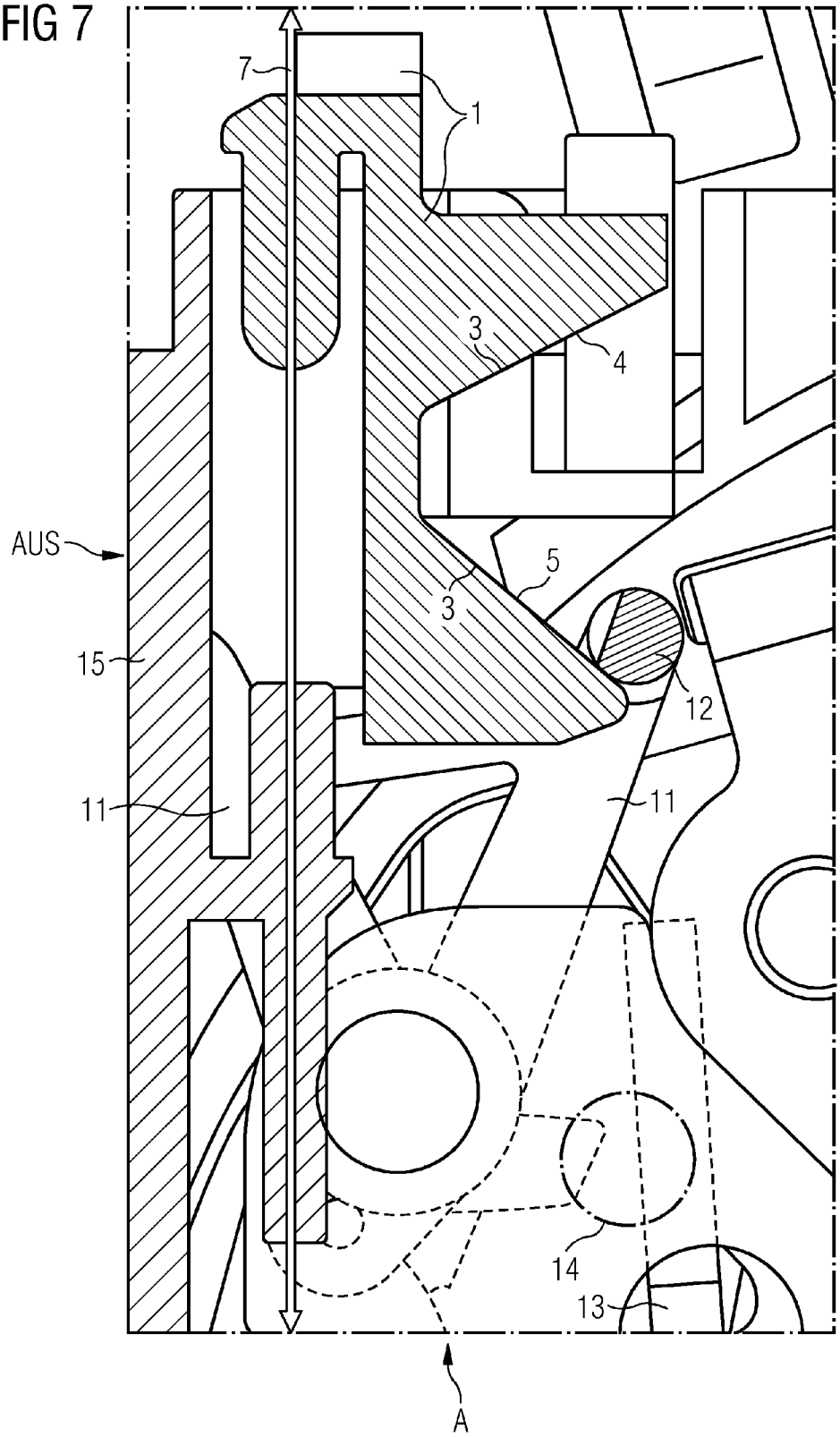
FIG. 7 shows a sectional view of the test button in accordance with FIG. 5, wherein the position of the tripping mechanism in relation to the pawl of the electrical switching device is illustrated.
Figure 8:
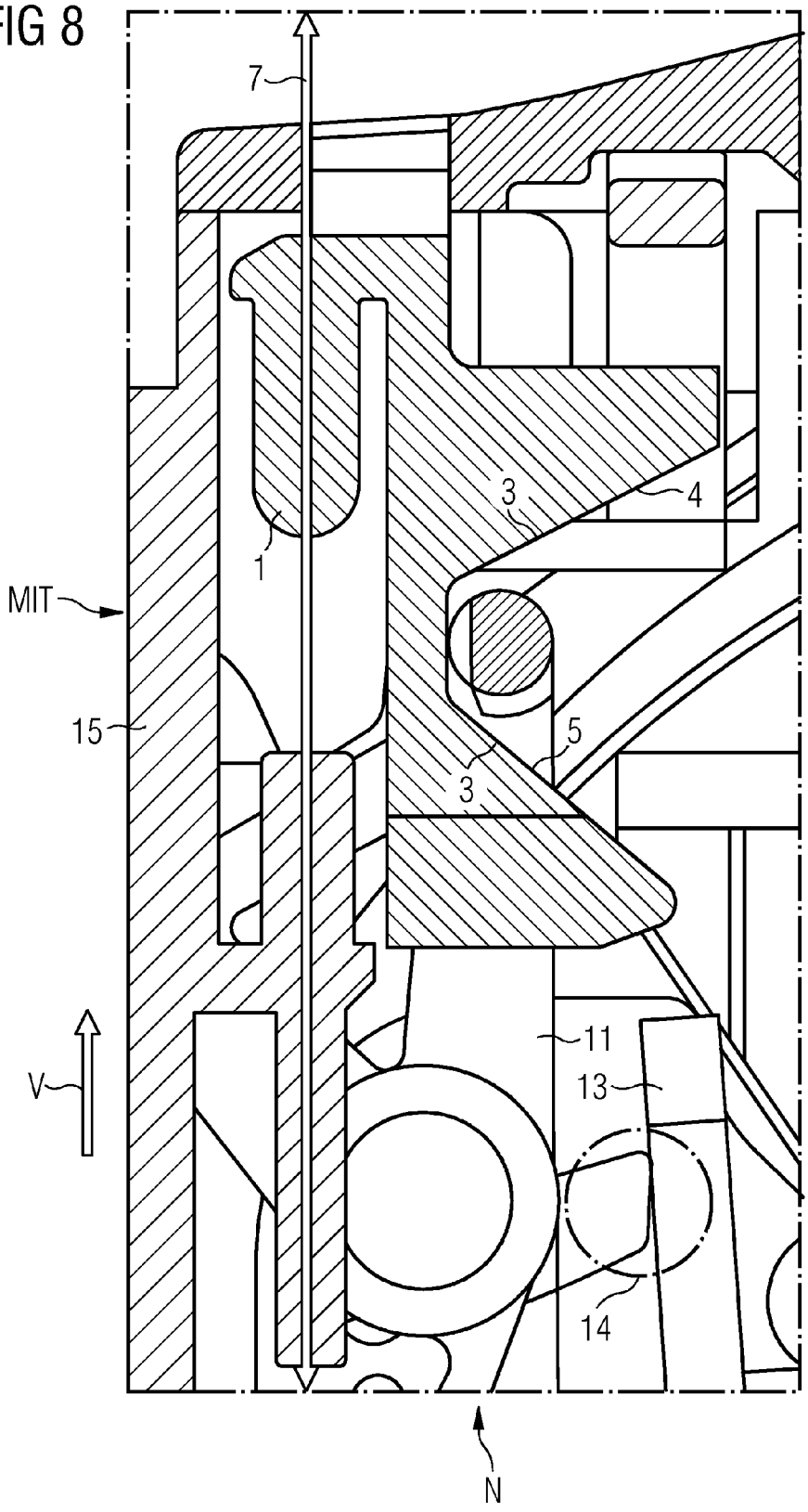
FIG. 8 shows a sectional view of the test button in accordance with FIG. 1, wherein the position of the tripping mechanism in relation to the pawl of the electrical switching device is illustrated.

FIGS. 7 and 8 respectively show a schematic sectional view of a test button 1 as well as a tripping mechanism 11 of an electrical switching device. In FIG. 7 the test button 1 is in the OFF position AUS and the tripping mechanism 11 is in the tripping position A. In this tripping position A of the tripping mechanism 11 the tripping mechanism 11 or the contact area 14 between the tripping mechanism 11 and a pawl 13 is not in contact with the pawl 13. This means that in FIG. 7 the electrical switching device of the switching mechanism of the electrical switching device respectively is in the tripping position A, i.e. in the TRIP position. The tripping mechanism 11 or the contact area 14 of the tripping mechanism 11 respectively has released the pawl 13 of the switching mechanism of the electrical switching device, so that the pawl in its turn has released the switching mechanism so that this can separate the at least one moving contact from the at least one fixed contact of the electrical switching device.

In FIG. 8 the switching mechanism of the electrical switching device is in the RESET position or in the OFF position respectively in which the switching mechanism of the electrical switching device can be transferred into the ON position or the switching mechanism or the electrical switching device respectively is already in the ON position. This means that the tripping mechanism 11 rests against the pawl 13 with its contact area 14.

The explanation of the embodiments of the test button or of the electrical switching device given here describes the present invention only within the framework of examples. Naturally individual features of the embodiments can be freely combined with one another, where this makes sense technically, without departing from the framework of the present invention.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims.

Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

LIST OF REFERENCE CHARACTERS

1 Test button
2 Spring element
3 Stop contour
4 First contact surface
5 Second contact surface
6 Contact surface
7 Direction of movement
8 Central area of the stop contour
10 Cover element/accessory cover of the electrical switching device
11 Tripping mechanism
12 Guide element
13 Pawl
14 Contact area between tripping mechanism and pawl
15 Housing element of the electrical switching device
16 Opening in cover element
AUS Test button in OFF position
MIT Test button in non-actuated position
EIN Test button in actuated position
N Neutral position of the tripping mechanism
A Tripping position of the tripping mechanism
V Pre-tensioning force of the spring element

What is claimed is:

1. An electrical switching device, comprising:

a switching mechanism, configured to connect and disconnect at least one movable contact from at least one fixed contact of the electrical switching device;

a housing element, configured to accommodate internal accessory components;

a cover element, configured to cover the internal accessory components;

a tripping mechanism, movable between a neutral position and a tripping position; and a test button configured to actuate the tripping mechanism and including a stop contour, the test button including a first contact surface and a second contact surface, the first contact surface being embodied for actuating the tripping mechanism when the test button is actuated manually and the second contact surface being embodied for actuating the tripping mechanism when the cover element is opened, the test button being movable between an OFF position, a non-actuated position and an actuated position, the test button being able to be brought into active contact with the tripping mechanism, wherein the switching mechanism, when the test button is moved from the non-actuated position against the pre-tensioning force of a spring element into the actuated position, separates the at least one movable contact from the at least one fixed contact of the electrical switching device, and wherein when the test button is moved from the non-actuated position into the actuated position, at least one area of the tripping mechanism is slideable along the first contact surface to move the tripping mechanism from the neutral position into the tripping position, wherein the switching mechanism, when the test button is moved by the pre-tensioning force of the spring element from the non-actuated position into the OFF position, separates the at least one movable contact from the at least one fixed contact of the electrical switching device, and wherein, when the test button is moved from the non-actuated position into the OFF position, the at least one area of the tripping mechanism is slideable along on the second contact surface for moving the tripping mechanism from the neutral position into the tripping position, and wherein, in the non-actuated position of the test button, the tripping mechanism is disposed in relation to the switching mechanism such that the electrical switching device is resetable from a TRIP position into a RESET-position and from an OFF position into an ON position.

2. The electrical switching device of claim 1, wherein the test button, when the cover element is closed, is moveable from the OFF position into the non-actuated position against the pre-tensioning force of the spring element and wherein the test button, when the cover element is opened, is moveable by the pre-tensioning force of the spring element from the non-actuated position into the OFF position.

3. The electrical switching device of claim 2, wherein the electrical switching device is a compact circuit breaker.

4. The electrical switching device of claim 2, wherein the test button is movably supported to allow linear displacement on the electrical switching device.

5. The electrical switching device of claim 2, wherein, in the non-actuated position of the test button, the at least one area of the tripping mechanism is disposed on or next to a central area of the stop contour.

6. The electrical switching device of claim 2, wherein the at least one area of the tripping mechanism is a guide element.

7. The electrical switching device of claim 1, wherein the test button is movably supported to allow linear displacement on the electrical switching device.

8. The electrical switching device of claim 1, wherein, in the non-actuated position of the test button, the at least one area of the tripping mechanism is disposed on or next to a central area of the stop contour.

9. The electrical switching device of claim 1, wherein the at least one area of the tripping mechanism is a guide element.

10. The electrical switching device of claim 9, wherein the guide element is formed by a projection.

11. The electrical switching device of claim 1, wherein the spring element is embodied as a compression spring.

12. The electrical switching device of claim 1, wherein the tripping mechanism is a tripping shaft.

13. The electrical switching device of claim 1, wherein the electrical switching device is a circuit breaker.

* * * * *